United States Patent [19]

Huh et al.

[11] Patent Number: 4,635,384

[45] Date of Patent: Jan. 13, 1987

[54] FOOTWEAR SOLE

[76] Inventors: Myung H. Huh, 102-1, Kwangan-dong, Nam-ku; Je S. Jeon, 77-8, Kwangan-dong, Nam-ku, both of Busan-si, Rep. of Korea

[21] Appl. No.: 613,417

[22] Filed: May 24, 1984

[51] Int. Cl.[4] ..... A43B 13/20

[52] U.S. Cl. ..... 36/29; 36/28; 36/30 A

[58] Field of Search ..... 36/102, 103, 28, 30 R, 36/31, 32 R, 30 A, 14, 3

[56] References Cited

U.S. PATENT DOCUMENTS

| | | | |
|---|---|---|---|
| 1,559,532 | 10/1925 | Smith | 36/28 |
| 2,065,856 | 12/1936 | Grover | 36/32 R |
| 2,725,645 | 12/1955 | Scala | 36/30 R |
| 4,229,889 | 10/1980 | Petrosky | 36/28 |
| 4,417,407 | 11/1983 | Fukuoka | 36/3 R X |

FOREIGN PATENT DOCUMENTS

| | | | |
|---|---|---|---|
| 2453534 | 5/1976 | Fed. Rep. of Germany | 36/32 R |
| 715643 | 9/1931 | France | 36/3 R R |
| 2250266 | 5/1975 | France | 36/30 R |
| 1444091 | 7/1976 | United Kingdom | 36/28 |

*Primary Examiner*—Werner H. Schroeder
*Assistant Examiner*—T. Graveline
*Attorney, Agent, or Firm*—Birch, Stewart, Kolasch & Birch

[57] ABSTRACT

A shoe sole comprising an upper sole having a banana configuration and a lower sole, said upper sole containing a forward air pocket and a rearward air pocket, said forward air pocket communicating with the rearward air pocket by a hollow corrugated section, said hollow corrugated section functioning between an expanded and contracted state depending on the pressure applied to said air pockets.

Accordingly, the present invention provides an improved version of footwear which enables one's body weight when combined with the footwear to provide additional power for walking or running.

8 Claims, 5 Drawing Figures

FOOTWEAR SOLE

FIELD OF THE INVENTION

The present invention relates to the sole of footwear and more particularly relates to an improved sole which puts one's best foot forward.

BACKGROUND OF THE INVENTION

Generally, conventional footwear imposes a burden of one's body weight while walking or running.

Accordingly, the present invention provides an improved version of footwear which enables one's body weight, when combined with the footwear, to provide additional power for walking or running.

BRIEF DESCRIPTION OF THE PRESENT INVENTION

The present invention has an air pocket formed in the middle portion of the sole. This air pocket gives the effect of both decreasing one's body weight with a rebound action, and putting one's foot forward effortlessly.

DETAILED DESCRIPTION OF THE PRESENT INVENTION

Figure 1:
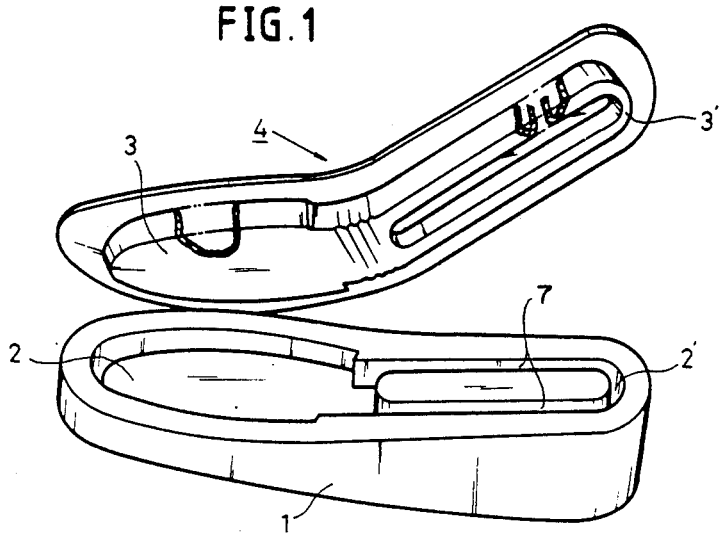
FIG. 1 is a perspective view of the present invention.
Figure 2:
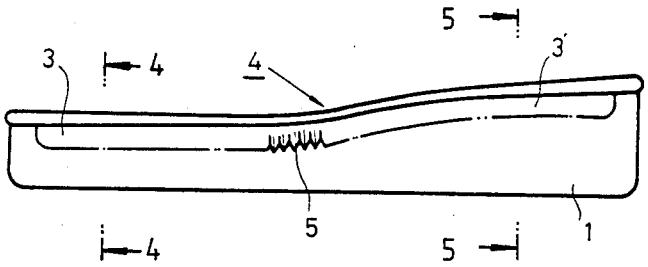
FIG. 2 is a lateral view of the present invention.

The present invention comprising a lower sole 1 formed with a spaced groove 2 in the front portion thereof, and with a horseshoe or U shaped narrow groove 2' in the back portion thereof, which is connected with the spaced groove 2, and a banana or obtusely angled shaped upper sole 4 formed with air pockets 3, 3', which are tightly inserted into the grooves 2, 2'. The upper sole 4 is attached to the lower sole 1 to form corrugated or fine wrinkles 5 in air pockets 3, 3' as shown in FIG. 2, and a solid material 6 (e.g. urethane foam) can be mixed with the air in the air pockets 3, 3'.

The upper sole 4 and air pockets 3, 3' are made of thin, durable material that has low elasticity, which prevents them from being broken or discharging the air contained in the air pocket 3, 3' which contain approximately 2 $Kg/cm^2$ of inner pressure.

The excessive amount of air charged into the air pockets 3, 3' provides more than the required pressure thereby creating a lower sole 1 attached to an upper sole 4 bent into the banana or obtusely angled shape. Therefore an appropriate amount of air must be charged into the air pocket 3, 3' to create the desired shape.

Figure 3:
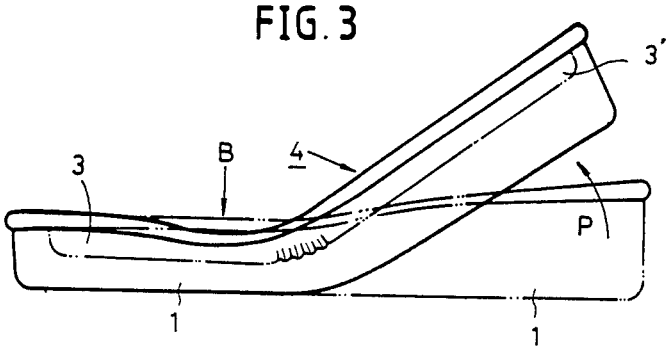
FIG. 3 is a simulated action view of the present invention.
Figure 4:
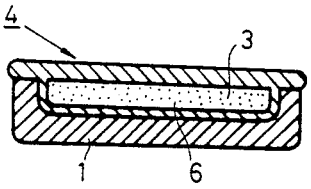
FIG. 4 is a cross section taken along line 4—4 of FIG. 2
Figure 5:
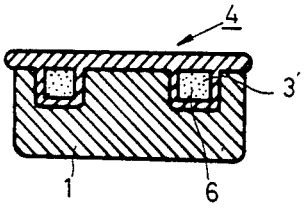
FIG. 5 is a cross section taken along line 5—5 of FIG. 2.

According to the present invetion, a footwear sole is pushed down in the front portion of an air pocket 3 formed in the spaced groove 2, as shown in portion B of FIG. 3, by means of one's body weight while walking.

Accordingly during walking the volume of air in the pockets 3, 3' is decreased to increase the inner pressure therein, which allows the air pockets 3, 3' to return instantly to the original shape (e.g. a banana or obtusely angled shape).

Even during running, footwear is not instantly bent into a banana or obtusely angled shape, therefore the air pockets 3, 3' try to return to the original state thus producing the potential power to push the heel up and maintain this power until the footwear sole is bent to the original state determined by the air pockets 3, 3'.

A potential power is explained by the following equation:

$$\downarrow B \cdot w = \downarrow b \cdot w + \nwarrow p$$

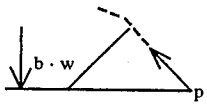

$$\nwarrow p = \uparrow p \cdot v + \leftarrow p \cdot h$$

$\downarrow$ B · w; one's body weight $\downarrow$ b · w; power to be pushed down by one's body weight in the front portion of the footwear while walking $\nwarrow$ p; power to return to the original state ("⌐" banana or obtusely angled shape) of air pockets $\uparrow$ p · v; power to push up in a vertical direction $\leftarrow$ p · h; power to push in a forward direction while walking According to the above equation:

$\downarrow B \cdot W >$ $\downarrow$ b · w; to have the effect of decreasing the burden of one's body weight during certain moments of the walking motion.

$\uparrow$ pv; to have the power effect of decreasing one's body weight $\leftarrow$ ph; to have the effect of pushing one's foot forward in a walking direction The size of the power useful for walking depends on the size of the $\nwarrow$ p The size of the $\nwarrow$ p depends on a multiple of the action area (S) and the inner pressure (P) produced by the constriction of air pockets 3, 3' during walking.

The action area is limited by the size of the footwear and mathematically expressed as a constant.

Consequently, the increase of $\nwarrow$ p depends on the increase of "P" only. In this case, the increase of the variable rate of volume ($K=V'/V$) results in an increased "P".

The method for increasing "K" is with as little air as possible and a large volume of a solid foam material (e.g. urethane foam) inserted into the air pockets 3, 3' in order to decrease "V", thereby increasing "K".

A solid material 6 is preferable with a good retention of compression.

Note:

P; pressure of inside of the air pockets produced by the compression thereof during walking K; variable rate of volume V'; volume compressed by one's body weight during walking in the front portion of the footwear sole V; volume during non-use S; bottom and lateral section of the portion bent in the air pocket A maximum value of "P" (P=body weight/area of the front portion bent) is calculated to be approximately 2 $Kg/cm^2$.

Because this footwear is designed with an air pocket 3' inserted into a narrow groove 2' of the lower sole 1, when a step is taken putting the heel down first into the back portion of the lower sole 1, pressure is not delivered to the air pocket 3' and the front portion of the lower sole 1 is not pushed up, consequently there is no problem in walking. The horseshoe or "U" shaped narrow groove 2' has two legs 7 thereof communicating with the forward air pocket 2.

The present invention, as described above, enables the wearer to walk conveniently and quickly due to the power action created by the air pockets 3 of the spaced portions of the lower sole 1.

What is claimed is:

1. A shoe sole, comprising:

an upper sole having an obtusely angled shape; and a lower sole, said upper sole containing a forward air pocket and a rearward air pocket, said forward air pocket communicating with said rearward air pocket by a hollow corrugated section, such that said hollow corrugated section expands or contracts depending on pressure applied to said air pockets, said lower sole having formed therein a cavity for receipt of said air pockets of said upper sole therein.

2. The shoe sole of claim 1 wherein the air pockets are filled with air.

3. The shoe sole of claim 2 wherein the air has a pressure of about 2 $kg/cm^2$.

4. The shoe sole of claim 1 wherein the air pockets arefilled with a combination of air and a foam material.

5. The shoe sole of claim 4 wherein the foam material is a urethane.

6. The shoe sole of claim 1 wherein the rearward air pocket has a substantially U-shaped configuration with the two legs thereof communicating with the forward air pocket via said hollow corrugated section.

7. The shoe sole of claim 6 wherein the cavity of said lower sole comprises a groove portion for receiving said forward and rearward air pockets and a projecting portion for engagement between the legs of the rearward U-shaped air pockets of said upper sole.

8. A shoe sole, comprising:

an upper sole having an obtusely angled shape; and a lower sole, said upper sole containing a forward air pocket and a rearward air pocket, said rearward air pocket having a substantially U-shaped configuration with the two legs thereof communicating with said forward air pocket through a hollow corrugated section, such that said hollow corrugated section expands or contracts depending on pressure applied to said air pockets, said lower sole having formed therein a cavity for receipt of said air pockets of said upper sole therein.

* * * * *